US005423505A

United States Patent [19]

David

[11] Patent Number: 5,423,505

[45] Date of Patent: Jun. 13, 1995

[54] APPARATUS FOR SUPPORTING AND DISPLAYING EYEGLASSES

[75] Inventor: Henry B. David, Glendale, Calif.

[73] Assignee: Melco Wire Products Co., Glendale, Calif.

[21] Appl. No.: 933,291

[22] Filed: Aug. 21, 1992

[51] Int. Cl.[6] ..... A47B 91/06

[52] U.S. Cl. ..... 248/214; 206/5; 206/486; 206/806; 211/13; 351/158

[58] Field of Search ..... 248/214, 215, 902; 206/486, 5 R, 488, 489, 482, 6, 478, 806; 351/41, 158; 211/13, 59.1

[56] References Cited

U.S. PATENT DOCUMENTS

| | | | |
|---|---|---|---|
| 2,557,552 | 6/1951 | Martin | 206/5 R |
| 2,764,286 | 9/1956 | Carmichael | 206/5 R |
| 3,040,881 | 6/1962 | McNeill | 206/488 |
| 3,291,300 | 1/1966 | Rosen | 206/5 R |
| 3,381,806 | 5/1968 | McDonagh | 206/5 R |
| 3,895,718 | 7/1975 | Seiller | 248/902 X |
| 4,944,389 | 7/1990 | Robertson | 206/486 X |
| 5,014,957 | 5/1991 | Nichol, Jr. | 206/806 X |
| 5,141,104 | 8/1992 | Morrow et al. | 206/5 R |

FOREIGN PATENT DOCUMENTS 0282460 9/1988 European Pat. Off. ..... 206/5 R

*Primary Examiner*—Blair M. Johnson
*Assistant Examiner*—Korie H. Chan
*Attorney, Agent, or Firm*—Michael A. Painter

[57] ABSTRACT

An apparatus for supporting and displaying non-prescription eyeglasses upon a cantilevered merchandise display assembly. A substantially rectangular, planar base member has a pair of temple supports depending downwardly therefrom at the lateral extremes of the base member. Each temple support has an aperture disposed therethrough for receiving one of the temples of the eyeglasses. The temple supports are partially severed outwardly from the circumference of each aperture in order to accommodate temples of varying sizes. The edge of the base member intermediate the temple supports is adapted to be spaced above the bridge of the eyeglasses and thereby avoid interference with the nose gap of the eyeglasses. The upper edge of the base member opposite the temple supports is extended upwardly into a support flange which is selectively engageable with the merchandising display assembly.

3 Claims, 3 Drawing Sheets

APPARATUS FOR SUPPORTING AND DISPLAYING EYEGLASSES

BACKGROUND OF THE INVENTION

1. Field of the Invention

The present invention generally relates to product displays, and more particularly to those product displays used to support and display eyeglasses.

2. Prior Art

The merchandising techniques employed by mass-merchandising outlets make increasing use of self-service merchandising displays. Such self-service displays present a customer with a variety of goods from which to make a selection. Such sales displays are used to market non-prescription eyeglasses. These may include non-prescription reading glasses which are generally known as magnifiers or non-magnifying sunglasses. Without sales personnel, a customer is permitted to select a pair of eyeglasses from the display, the choice being based on whatever aesthetic or functional requirements the customer may have. The one factor in common in all such sales displays is the large variety of sizes, colors, and/or degree of magnification. Irrespective of whatever factors the customer may be considering, the merchandising display must permit the customer to selectively remove and/or return eyeglasses which are being considered for purchase.

One of the earliest and simplest merchandising displays for eyeglasses merely provides an individual slot or container for each pair of eyeglasses. As an alternative, cantilever displays allow a plurality of individual pairs of sunglasses to be mounted along a single cantilevered support or arm. On the other hand, the means used to hang and display the eyeglasses do not permit the glasses to be selectively removed and/or returned to the display. As a result, if the customer wishes to examine a pair of eyeglasses which is not at the end of the cantilevered support, the unwanted pairs of eyeglasses must be removed in order to allow access to the selected pair. The inadequacies of this design are obvious. Where a customer is required to remove unwanted merchandise in order to gain access to the eyeglasses being considered for purchase, the removed merchandise could be damaged, lost or inadvertently returned to the wrong location.

As will be described in detail hereinbelow, the present invention allows a customer to try on a pair of eyeglasses without removing the eyeglasses from the apparatus which permits them to be coupled to the merchandising display. Although there are devices taught by the prior art which allow eyeglasses to be examined without removal from the supporting apparatus, they fail to provide selective access to the displayed merchandise. One of the devices taught by the prior art employs a substantially rectangular member which has an aperture disposed therethrough to permit the serial mounting of a plurality of supported eyeglasses upon a cantilevered arm. The eyeglasses are secured to the member by an extending element which passes through the nose gap of the eyeglasses and is then bent to form a loop that surrounds the eyeglass frame bridge. Although this device permits a customer to examine the eyeglasses without removal of the supporting member, selective access to mounted merchandise is precluded.

The present invention substantially resolves those inadequacies which are inherent in those devices taught by the prior art. The present invention support and display apparatus is coupled to the temples of the eyeglasses without obstructing the nose gap. In this manner, the eyeglasses may be placed on the face of the user without removing the glasses from the supporting apparatus. The base member which is coupled to the eyeglasses is provided with a supporting flange which allows selective engagement with a cantilevered merchandising support thereby resolving the problem of potential damage or loss of displayed merchandise.

SUMMARY OF THE INVENTION

The present invention comprises an individual support and display apparatus which is adapted to allow selective access to merchandise and permit a customer to try on the eyeglasses without the necessity of removing the support and display apparatus. The support and display apparatus comprises a rectangular, planar base member constructed of a resilient plastic sheet material. The bottom edge of the base member at lateral extremes thereof is extended downwardly into a pair of extensions, each being adapted to engage a temple of the eyeglasses. For the purpose of engaging the eyeglass temple, one or more apertures are disposed through each tab in which the temple is disposed. To compensate for temples of different sizes, the tabs may be severed in a plurality of locations about the circumference of each aperture. The distance between the apertures and the lower edge of the base member places the base member above the bridge of the eyeglass frame in order to avoid obstructing the nose gap. In this manner, the customer may try on the eyeglasses without removing the support and display apparatus.

To provide selective access to mounted eyeglasses, a support flange extends upwardly from the upper edge of the base member. The present invention is adapted to be supported from a merchandise display assembly which utilizes a single cantilevered extension arm. The supporting flange lies in the same plane as the base member and provides a lateral opening which permits the present invention to be removed from the cantilevered arm in a direction perpendicular to the cantilevered arm. For security purposes, the lateral opening of the support flange will frictionally engage the cantilevered arm thereby requiring a positive force for removal.

It is therefore an object of the present invention to provide an improved construction for a product support and display apparatus.

It is another object of the present invention to provide a support and display apparatus for eyeglasses which permits selectable access to mounted eyeglasses.

It is still another object of the present invention to provide an improved support and display apparatus for eyeglasses which permits a customer to try the eyeglasses on while the support and display apparatus is affixed thereto.

It is still yet another object of the present invention to provide an improved support and display apparatus for eyeglasses which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
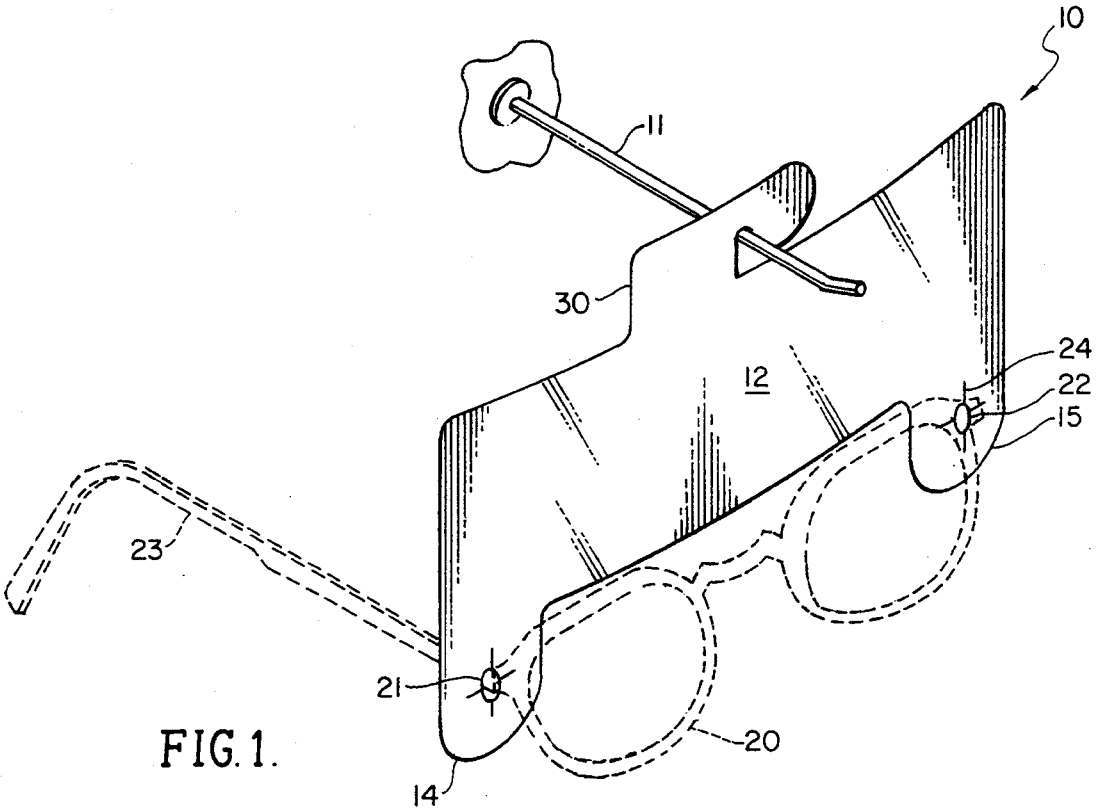
FIG. 1 is a perspective view of a support and display apparatus constructed in accordance with the present invention mounting a pair of eyeglasses on a cantilevered bar.
Figure 2:
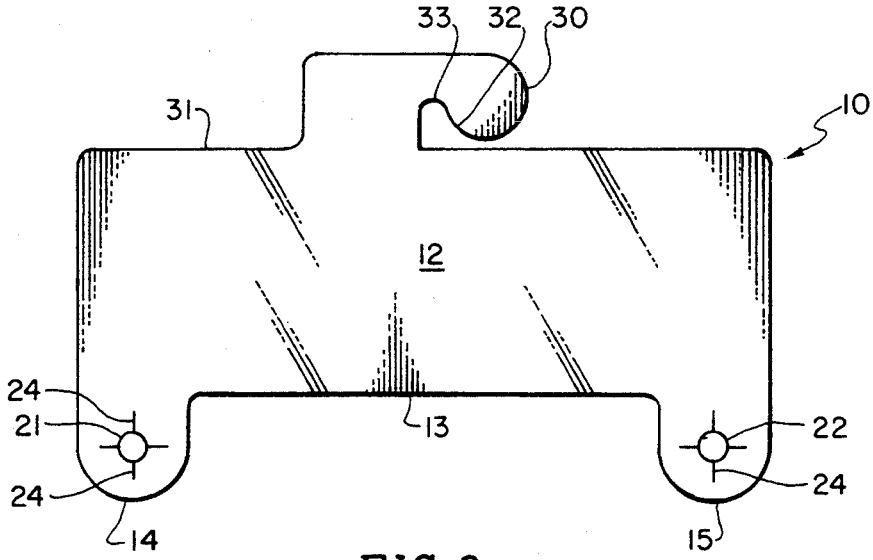
FIG. 2 is a front elevation view of the present invention support and display apparatus shown in FIG. 1.

An understanding of the present invention can be best gained by reference to FIG. 1 and FIG. 2 wherein a support and display apparatus 10 in accordance with the present invention can be best seen. The present invention support and display apparatus 10 is intended to be suspended from a conventional merchandise display apparatus which utilizes a cantilevered extension arm 11. Although FIG. 1 illustrates only a single support and display apparatus 10 being suspended from extension arm 11, it is understood the structure of the present invention is adapted to permit a plurality of apparatus 10 to be serially disposed along and suspended from extension arm 11.

The primary objective of the present invention is to provide means for displaying non-prescription eyeglasses. The preferred embodiment of the present invention comprises a substantially rectangular, planar base member 12 which is fabricated from a resilient plastic sheet material. The lateral extremes of the lower edge 13 of base member 12 are extended downwardly into mounting tabs 14 and 15. In order to mount eyeglasses 20 on apparatus 10, apertures 21 and 22 are disposed through supporting tabs 14 and 15 at positions which are uniformly, vertically spaced below lower edge 13. Eyeglasses 20 are to be mounted by inserting each of the temples 23 through the respective apertures 21 and 22. Since the ends of eyeglass temples vary in size, a plurality of linear openings 24 are disposed into the mounting tabs 14 and 15 outwardly from the circumference of apertures 21 and 22. When temples 23 are disposed into apertures 21 and 22 as shown in FIG. 1, the resilient plastic material defining apertures 21 and 22 will, if necessary, be resiliently deflected to maintain frictional engagement with eyeglass temples 23. As will be described in detail hereinbelow, temples 23 are inserted through apertures 21 and 22 until said apertures are adjacent the hinges 25 intermediate the temples 23 and the remainder of the frame of eyeglasses 20.

As stated, it is an objective of the present invention to permit selective access to any of a plurality of support and display apparatus 10 which may be suspended along extension arm 11. To meet this objective, support flange 30 extends upwardly from the upper edge 31 of base member 12. Support flange 30 incorporates a curvilinear insert 32, the upper terminus 33 of which is adapted to engage extension arm 11. Support flange 30 is constructed to insure that upper terminus 33 lies along the axis which bisects base member 12 and the supported eyeglasses 20. By placing upper terminus 33 at the center of base member 12, the supported eyeglasses 20 will be displayed in an unskewed manner.

For a customer to selectively access a plurality of displayed eyeglasses 20, the select support and display apparatus 10 is urged horizontally perpendicular to and in opposition to the opening of curvilinear insert 32. To prevent the support and display apparatus 10 from being inadvertently dislodged from extension arm 11, the minimum distance between curvilinear insert 32 and upper edge 31 of base member 12 is less than the diameter of extension arm 11. In this manner, a support and display apparatus 10 may be removed from extension arm 11 only by applying a force which will exceed the frictional engagement between extension arm 11 and surfaces 31 and 32 of apparatus 10.

Figure 3:
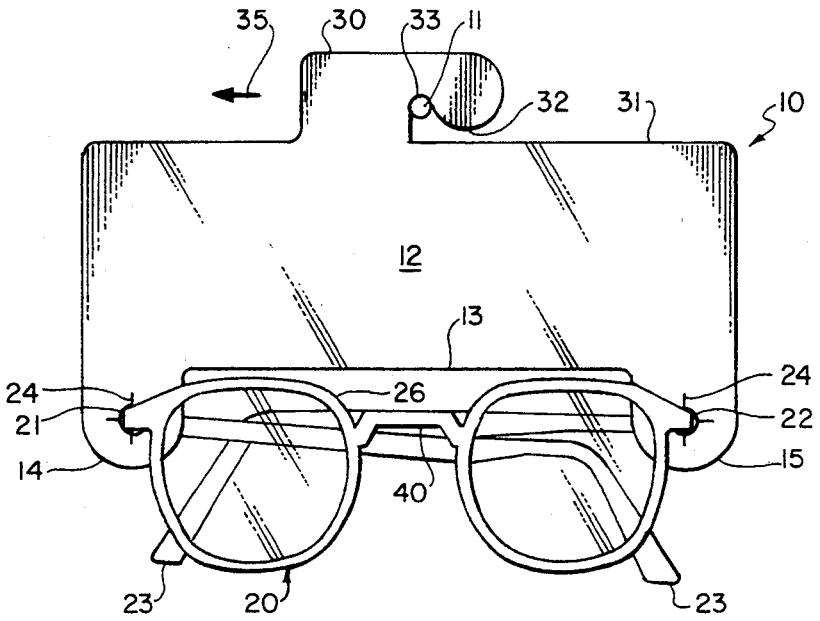
FIG. 3 is a front elevation view of the present invention support and display apparatus mounting a pair of eyeglasses in the folded position.
Figure 4:
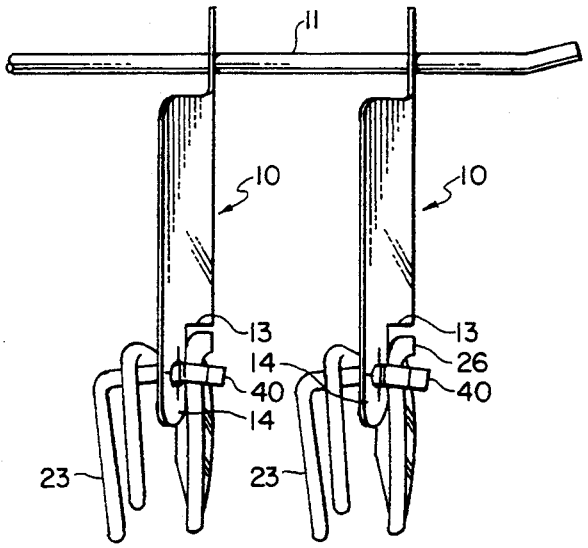
FIG. 4 is a side elevation view of the present invention as shown in FIG. 3.
Figure 5:
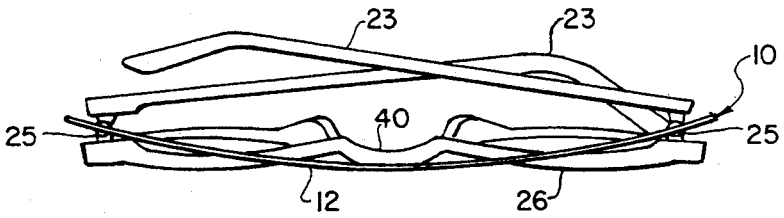
FIG. 5 is a top elevation view of the present invention support and display apparatus shown in FIG. 3.

An understanding of the use of the present invention may be best gained by reference to FIGS. 3, 4 and 5. FIG. 3 illustrates the manner in which the apparatus 10 is mounted upon a merchandising assembly extension arm 11. As shown in FIG. 4, support and display apparatus 10 permits a plurality of like structures to be serially suspended from the extension arm 11. In order to provide for compact displays, the eyeglasses 20 must be mounted with the temples 23 in the closed position. This requires that temples 23 be disposed through tabs 14 and 15 until tabs 14 and 15 are adjacent the hinges 25 intermediate temples 23 and frame 26 of eyeglasses 20. Each of the plurality of apparatus 10 are suspended from extension arm 11 at upper terminus 33. A customer is able to selectively examine any of the eyeglasses 20 by urging apparatus 10 in the direction indicated by the reference numeral 35.

A primary objective of the present invention is to permit a customer to try on the eyeglasses 20 without removal of the eyeglasses 20 from support and display apparatus 10. In order to meet this objective, the support and display apparatus must not interfere with the nose gap disposed immediately below the bridge 40 of frame 26. In addition, the customer will be able to place the eyeglasses 20 in an appropriate position only if the surface of base member 12 does not interfere with the face of the customer. To avoid interference with the nose gap, apertures 14 and 15 are uniformly disposed beneath lower edge 13. To avoid interference with the customer's face, base member 12 is positioned in a manner whereby it's surface will be disposed forwardly of bridge 40 and a substantial portion of frame 26. This feature is met when the distance between apertures 14 and 15 is greater than the distance between temples 23 of eyeglasses 20. Since base member 12 is constructed of flexible plastic sheet material, the mounting of temples 23 through apertures 15 will cause the surface of base member 12 to be curved in the manner shown in FIGS. 4 and 5.

Figure 6:
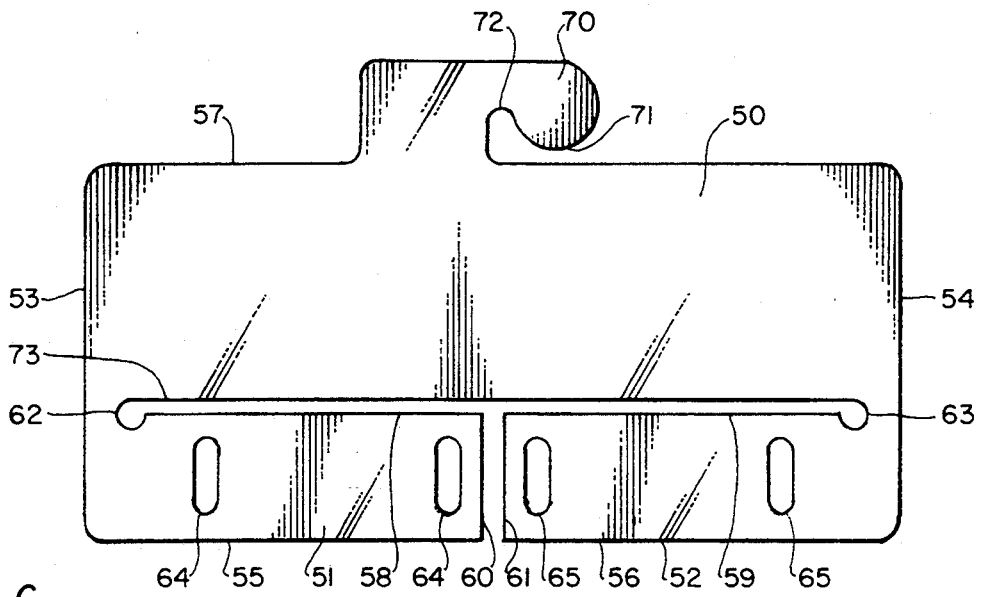
FIG. 6 is a front elevation view of an alternative embodiment of the present invention support and display apparatus.
Figure 7:
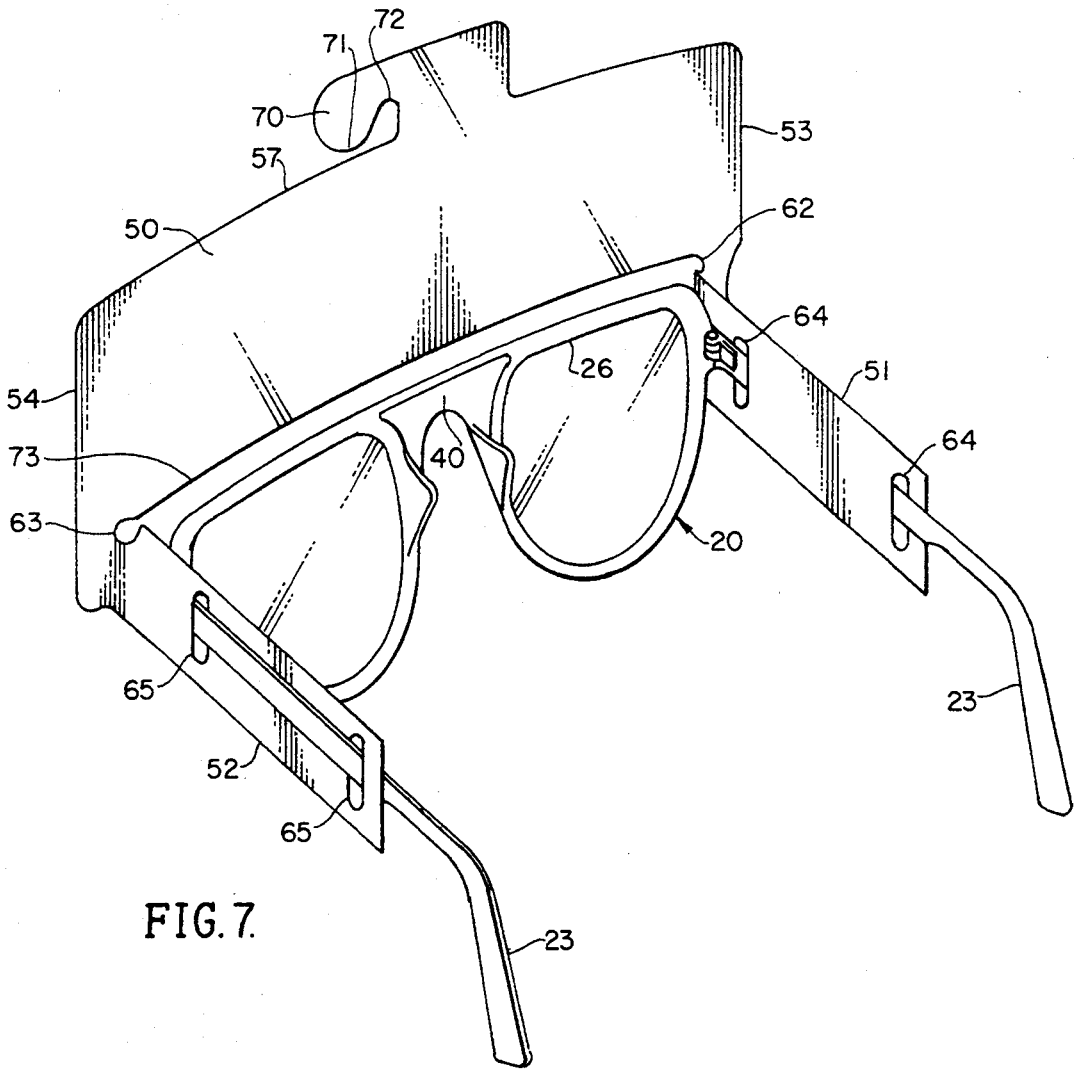
FIG. 7 is a perspective view of the alternative embodiment of the support and display apparatus shown in FIG. 6 illustrated with a mounted pair of eyeglasses.

An alternative embodiment of the present invention may be best seen by reference to FIG. 6 and FIG. 7. The preferred embodiment of the present is shown in FIGS. 1–5, inclusive, and provides for the mounting of eyeglasses 20 substantially adjacent the hinges coupling temples 23 to frame 26. The alternative embodiment of the present invention provides means for the mounting of eyeglasses 20 when the construction of the hinges could be damaged if the forces imposed thereon are excessive. The alternative embodiment of the present invention shown in FIGS. 6 and 7 provide for an alternative structure for mounting eyeglasses 20 which does not impose any direct force on the hinges.

In the alternative embodiment of the present invention, a planar base member 50 is constructed from a resilient plastic sheet material. A pair of flanges 51 and 52 are integral with the lateral extremes of base member 50 and depend inwardly from edges 53 and 54, respectively. The lower edges 55 and 56 of flanges 51 and 52, respectively, are aligned with each other and are in parallel spaced relation to upper edge 57 and lower edge 73 of base member 50. The upper edge 58 of flange 51 is in parallel spaced relation to lower edge 55. In a like manner, the upper edge 59 of flange 52 is in parallel spaced relation to lower edge 56. The terminus 60 and 61 of flanges 51 and 52 are substantially adjacent one another at the center of base member 50.

Flanges 51 and 52 form a resilient coupling for eyeglasses 20. Upper edge 58 of flange 51 terminates at cut-out 62. Upper edge 59 of flange 52 terminates at cut-out 63. Cut-outs 62 and 63 provide fulcrums about which flanges 51 and 52 may respectively pivot. Since flanges 51 and 52 are constructed of the same resilient plastic sheet material as base member 50, an inwardly directed force will be imposed by each flange 51 and 52 when eyeglasses 20 are mounted therein. A pair of apertures 64 and 65 are disposed in flanges 51 and 52, respectively, each set of flanges 51 and 52 being adapted to receive the temples 23 of eyeglasses 20.

In meeting the objectives of the present invention, a support flange 70 extends upwardly from upper edge 57 of base member 50. As was described in connection with the embodiment disclosed in FIGS. 1–5, inclusive, support flange 70 incorporates a curvilinear insert 71, the upper terminus 72 thereof being adapted to engage the merchandise display arm 11 (FIG. 1). In the alternative embodiment illustrated in FIG. 6, upper terminus 72 lies along the central axis of base member 50 and bisects the gap between terminus 60 and 61 of flanges 51 and 52.

The manner in which the alternative embodiment of the present invention meets the stated objectives may be best seen by reference to FIG. 7. The left and right temples 23 of eyeglasses 20 are interleaved through apertures 65 and 64, respectively. In the embodiment shown in FIG. 7, no direct force is imposed on the hinges which lie intermediate temples 23 and frame 26 of eyeglasses 20. Apertures 64 and 65 are formed in flanges 51 and 52 at locations uniformly below lower edge 73 of base member 50. As can be seen in FIG. 7, lower edge 73 is disposed upwardly from bridge 40 in a manner which will allow the customer to try on the eyeglasses without removing the support and display apparatus. To further avoid interference with the customer's face, base member 70 must be positioned in a manner whereby its surface will be curved forwardly of bridge 40 and a substantial portion of frame 26. This feature is met when the distance between cut-outs 62 and 63 is greater than the distance between temples 23 of eyeglasses 20. Since base member 70 is constructed of flexible plastic sheet material, the mounting of temple 23 through apertures 64 and 65 will cause the surface of base member 70 to be curved forwardly of bridge 40 in the manner shown in FIG. 7.

It is therefore submitted the present invention provides an improved support and display apparatus for merchandising non-prescription eyeglasses. Utilizing modern merchandising displays, a plurality of eyeglasses may be mounted on a cantilevered extension arm in a manner which will provide a customer with random access to any one of the sunglasses the customer wishes to examine. Furthermore, the customer may try on the eyeglasses without the need of removing the eyeglasses from the present invention support and display apparatus.

I claim:

1. A pair of eyeglasses and support and display means for selectively mounting said eyeglasses on a horizontally extended cantilevered arm, said eyeglasses including first and second sections for maintaining first and second lenses and first and second temples hinged to said frame from said first and second sections, respectively, said support means comprising a substantially rectangular base member having upper and lower edges, a pair of support tabs integral with and extending downwardly from the lateral extremes of the lower edge of said base member and having apertures disposed therethrough each adapted to receive and engage one of the first and second temples, respectively, of the eyeglasses, the distance between the apertures being greater than the distance between the first and second temples of the eyeglasses, each aperture being equidistant from the lower edge of said base member, and a flange extending upwardly from the upper edge of said base member, said flange including a curvilinear insert, the uppermost edge thereof lying upon the principal axis of said base member and be adapted to be adjacent the horizontally extended cantilevered arm whereby said support means will be suspended from cantilevered arm in an unskewed manner.

2. A pair of eyeglasses and support means as defined in claim 1 wherein a plurality of openings are disposed in said support tabs radially outwardly from the periphery of said apertures.

3. A pair of eyeglasses and support means as defined in claim 1 wherein the distance between the curvilinear insert and the upper edge of said base member is greater than the vertical width of the cantilevered arm.

* * * * *